United States Patent [19]

Schueler

[11] 4,397,410

[45] Aug. 9, 1983

[54] BURSTER

[75] Inventor: Marlin A. Schueler, San Leandro, Calif.

[73] Assignee: Swingline Inc., Long Island City, N.Y.

[21] Appl. No.: 244,753

[22] Filed: Mar. 17, 1981

Related U.S. Application Data

[63] Continuation of Ser. No. 922,744, Jul. 7, 1978, abandoned.

[51] Int. Cl.[3] ..... B26F 3/02

[52] U.S. Cl. ..... 225/98; 225/100

[58] Field of Search ..... 225/100, 97, 98, 93, 225/77.4, 79

[56] References Cited

U.S. PATENT DOCUMENTS 2,513,093 6/1950 Hageman .
2,778,424 1/1957 Hageman et al. .
3,004,693 10/1961 Johnson .
3,045,883 7/1962 Andrews et al. .
3,504,833 4/1970 Faltin et al. .
3,510,033 5/1970 Schramm et al. .
3,856,196 12/1974 Bayne et al. .
4,145,035 3/1979 Moser .

FOREIGN PATENT DOCUMENTS 697805 11/1964 Canada .
2247099 2/1975 France .
1234333 3/1971 United Kingdom .

*Primary Examiner*—Frank T. Yost
*Attorney, Agent, or Firm*—Pennie & Edmonds

[57] ABSTRACT

An improvement in a machine for longitudinally separating portions of a continuous web of paper has a triangularly shaped breaking element engaging the under side of the web with spaced apart breaking triangles for ripping the paper along perforation lines and accommodating intermittant longitudinal web displacement.

10 Claims, 6 Drawing Figures

BURSTER

This is a continuation of application Ser. No. 922,744, filed July 7, 1978, now abandoned.

BACKGROUND OF INVENTION

Many different types of forms or the like are conventionally printed upon a continuous web of paper having lateral perforations for subsequent separation of the individual forms. Invoices, records, checks, computer readouts and many other types of printed forms and records are conventionally formed in the foregoing manner, at least in parts to increase the available speed of printing and ease of handling. Separation of the individual forms or pages from the continuous web or strip of stationery is commonly accomplished by means of a "burster" which pulls apart successive sheets along the perforation lines of the web.

Conventional bursters employ a pair of feed rollers which grip a web of paper and feed the web forwardly into a pair of contacting snap rollers which are driven at a rate of rotation greater than the feed rollers, so as to grip and jerk or yank the end of the web, and the pairs of rollers are separated so that one perforation line across the web will be disposed therebetween. In order to ensure separation of the web along perforation lines, there are commonly provided a plurality of knobs or the like, which are disposed between the pairs of rollers and over which the web is passed, with these knobs being located at the desired separation line across the web. It is also known to employ a guillotine type of device for cutting portions from a continuous web of stationery, however, the present invention relates to the previously-noted type in which the leading portion of a web is separated by bursting the perforations laterally thereacross.

As the term "burster" indicates, conventional machines of this type simultaneously part the small connection portions of the paper between perforations, and while this type of separation is generally satisfactory, the bursting action causes a substantial noise emission. The simultaneous parting of a substantial number of small pieces of paper between perforations unavoidably produces a substantial noise, and with high speed operation as is generally required, the resultant noise level often becomes quite objectionable. High speed burster operation may, in fact, be hazardous to health of human ears, as determined by Government regulations.

At least certain types of conventional bursters suffer from an additional problem of intermittently tearing or gouging edges of separated sheets along the perforation lines. This difficulty arises from intermittent misalignment of perforation lines with separating knobs or breaking rolls, and, of course, this is highly disadvantageous inasmuch as certain separated sheets may thus become unuseable.

The present invention comprises an improvement upon conventional bursters by the provision of an improved breaking element or surface which causes an entirely different type of separation along perforation lines, and which accommodates misalignment of the perforation lines with the primary breaking surface.

SUMMARY OF THE INVENTION

The present invention provides an improvement in conventional bursters for separating short forms from continuous stationery wherein a pair of contacting feed rollers advances the continuous stationery or web of paper into engagement with a pair of snap rollers driven at a greater rate of rotation than the feed rollers for gripping the paper and pulling the paper so as to separate same along a perforation line located between the pairs of rollers. An improved breaking surface is provided by the present invention in the form of an upwardly extending triangular surface or pyramid having the apex thereof located at the desired breakline, i.e., the perforation line of the web. The breaking surface is located beneath the web of paper with the apex thereof extending upwardly of the plane between the contacting surface of the pairs of rollers, so as to fold the web of paper onto the downwardly inclined lateral edges of the breaking surface, whereby gripping of the folded edge of the web by the second pair of driven rollers causes the web to tear from the center thereof laterally outward in both directions along the perforation line. This produces a tearing or ripping action along the perforation line rather than a bursting action wherein all portions of the paper between perforations are simultaneously separated. The ripping or tearing action of the present invention occurs with sufficient rapidity to accommodate any desired speed of operation of the burster, however, the alternative action hereof, materially reduces the noise emission from the separation of successive sheets from the web.

The present invention additionally incorporates a second triangular or pyramidal breaking surface having the apex thereof horizontally aligned with the apex of the primary breaking surface described above, and spaced a short distance therefrom in the direction of web travel. The double breaking surface of the present invention accommodates the intermittent displacement of the perforation line with the breaking surface as normally occurs in conventional bursters. This situation which is further described below, results from the necessary provision of flats upon one of the feed rollers and will normally occur every so often in burster operation. With conventional bursters, this displacement or misalignment often produces a gouging or tearing of the paper itself, and the improved structure of the present invention precludes such a problem.

DESCRIPTION OF FIGURES

The present invention is described with respect to a particular preferred embodiment thereof in the accompanying drawings wherein.

DESCRIPTION OF PREFERRED EMBODIMENT

Figures 1, 2:
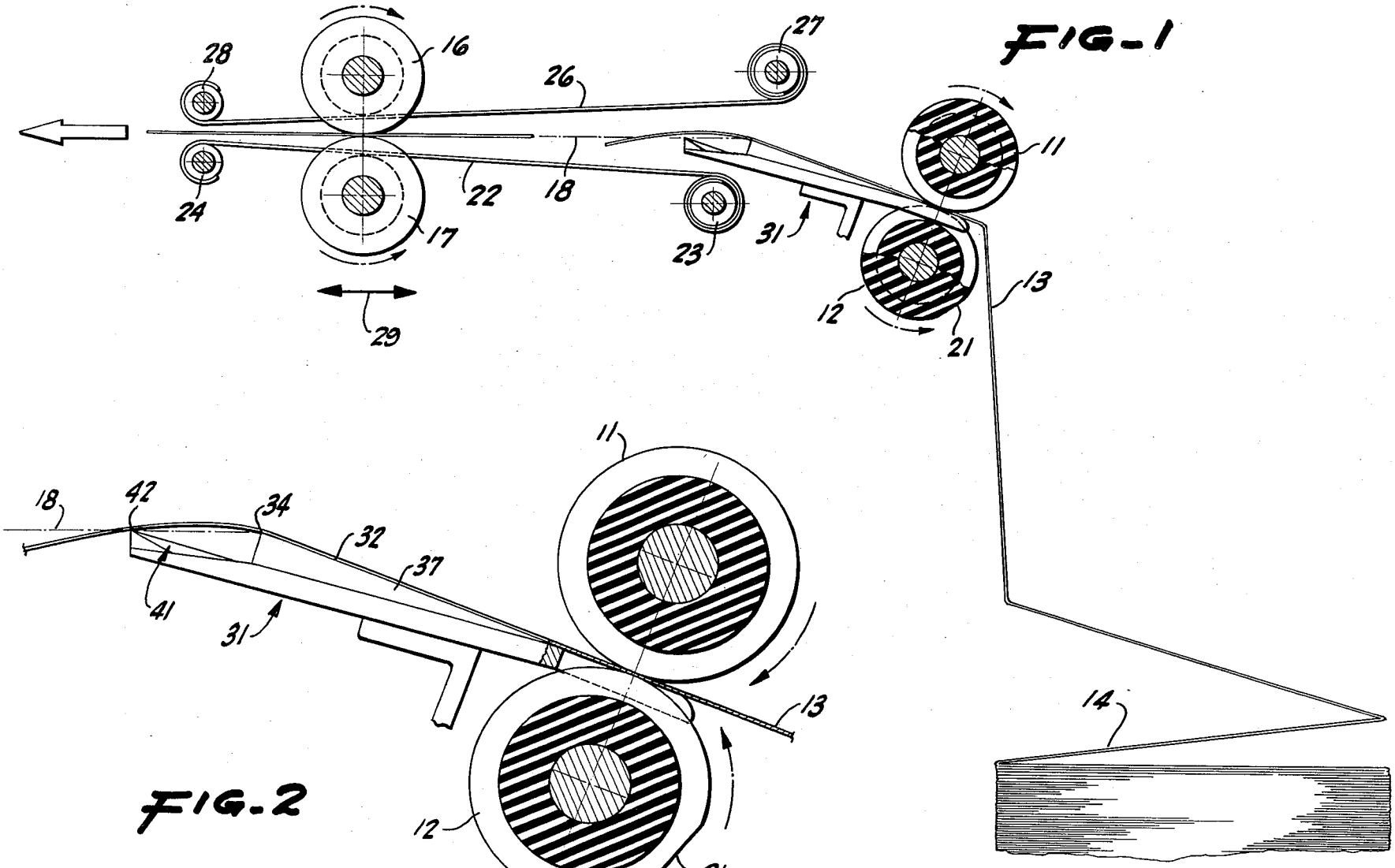
FIG. 1 is a diagramatic central vertical sectional view of relevant parts of a bursting machine incorporating the present invention.
FIG. 2 is a side elevational view of the improved breaking element of the present invention.

Referring now to FIG. 1 of the drawings, there will be seen to be provided a first pair of driven rollers or feed rollers 11 and 12 adapted to receive and feed a web 13 of continuous paper or stationery from a stack 14 thereof. The web 13 passes between the otherwise contacting feed rollers which are rotated at a predetermined rate to force or feed the web therethrough.

A second pair of contacting driven snap rollers 16 and 17 are disposed in spaced relationship to the pair of feed rollers with the line of contact of the second pair of rollers lying in the same plane as the line of contact of the feed rollers. This plane is inclined upwardly from the feed rollers. The second pair of rollers 16 and 17, which may be termed draw or snap rollers, are driven at a rate of rotation substantially in excess of the rate of rotation of the feed rollers, and rollers 16 and 17 forcibly engage each other so as to firmly grip a web of paper 13 which enters therebetween so as to draw the web forcibly to the left of FIG. 1.

Each of the rollers described above are provided with longitudinally spaced annular grooves, as illustrated by the dashed lines in FIG. 1, and these rollers are formed of rubber for gripping of the web 13 without damage thereto. It has been found in the manufacture of conventional bursters employing rubber rollers that it is only possible to control the diameter of those rollers within a limited tolerance. Consequently, it has been found necessary in conventional practice to provide a short flat surface 21 on one of the feed rollers 12. The unavoidable variation in diameters of the feed rollers which are tightly pressed together in order to grip and feed the web of paper will unavoidably cause accumulated lateral direction of feed of the web unless gripping of the web is intermittently released, and the flat surface 21 is provided for this purpose. With the feed rollers rotating in a rapid rate, the small flat surface 21 does not noticeably effect the feed of the web other than to allow the web to be fed normal to the axes of the feed rollers. The provision of a small flat surface on one of the feed rollers does, however, introduce a difficulty in the operation of conventional bursters as further described below.

In addition to the spaced pairs of rollers, provision is made in the burster for limiting possible travel of the web 13 above and below the common plane between the intersecting surface of the pairs of rollers. Such means may, for example, comprise a plurality of lower tapes 22 which are wound about a spring loaded rod 23 parallel to the axes of roller 12 adjacent the output side of the feed rollers and beneath a horizontal plane 18, shown in FIG. 1 with the tapes 22 extending generally parallel to the plane 18 through the annular grooves in the roller 17 and into engagement with a fixed rod or the like 24 in the output side of the rollers 16 and 17. A similar arrangement is provided above the plane 18 with tapes 26 extending from a spring loaded rod 27 above the plane 18 through the annular grooves in the roller 16 into engagement with a fixed rod 28 on the output side of the rollers 16 and 17. It will, of course, be appreciated that the distance between the pairs of rollers is variable in order to accommodate the separation of sheets of different lengths from different webs of paper, and generally, the draw or snap rollers 16 and 17 are moveable, as indicated by the arrow 29. As these rollers are moved relative to the feed rollers, the tapes 22 and 26 will be lengthened or shortened by reeling in or reeling out from the spring loaded rods 23 and 27.

Figure 3:
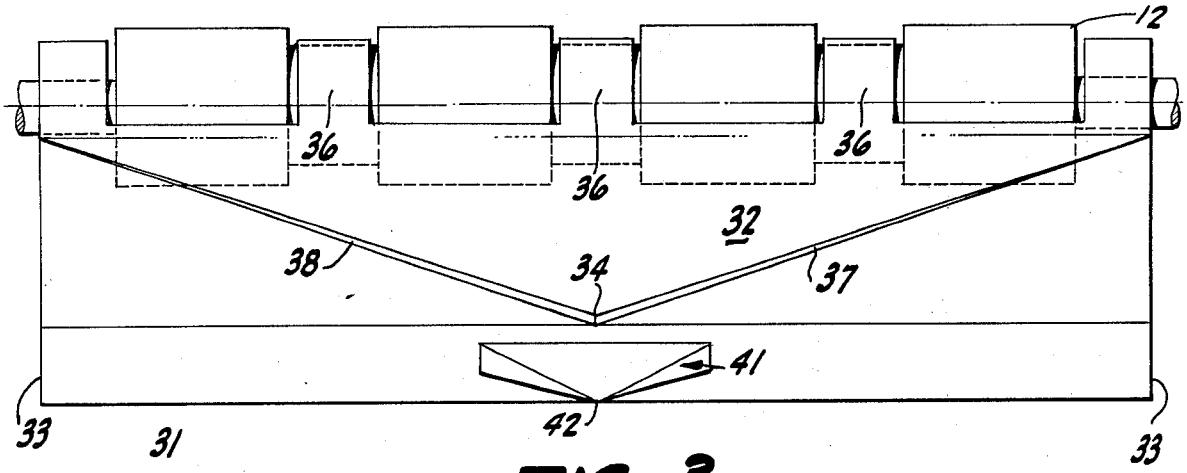
FIG. 3 is a top plan view of the breaking element of the present invention.

The present invention provides an improved breaking surface or breaking element 31 which is separately illustrated in FIGS. 2 and 3. The breaking element provides a triangular breaking surface 32 inclinded upwardly from a plate portion 33 to an apex 34 disposed centrally of the lateral edges of the plate. The plate 33 is mounted in the burster to locate the apex 34 of the triangular breaking surface 32 in the horizontal plane 18 through the intersection of the rollers 16 and 17 adjacent the outputs of the feed rollers 11 and 12. The leading edge of the plate 33 is provided with a plurality of fingers 36, which extend generally planarly with the surface 32 in spaced apart relation to fit into the annular grooves in the feed roller 12. Consequently, the web of paper 13, which is fed between the rollers 11 and 12, will rest upon the fingers 36 as well as the roller 12 as the web is moved between feed rollers in order to prevent any possible folding or catching of the leading edge of a web being threaded into the machine.

The breaking surface 32 will be seen to be inclined upwardly from the plane 18, so that the web of paper fed onto the surface 32 by the feed rollers 11 and 12 will tend to fold over the leading edges 37 and 38 of the inclined breaking surface 32. These edges 37 and 38 are inclined downwardly of the plate 32 in extension laterally thereof and in FIG. 4, the disposition of the web of paper 13 over the breaking surface 32 is illustrated.

In addition to the foregoing portions of the breaking element of the present invention, there is additionally provided a secondary breaking surface or unit 41 which may take the form of a small four-sided pyramid, having an apex 42 immediately above the leading edge of the plate 33, and horizontally aligned with the apex 34 of the breaking surface 32. The longitudinal separation of the apex 34 and 42 is normally of the order of three-quarters of an inch in a conventional burster, although this dimension may be varied in accordance with a variety of factors further discussed below. The lateral dimension of the unit 41 is preferably considerably less than that of the triangular breaking surface 32 and other dimensions and proportions of the secondary breaking unit 41 are generally not critical. It is, however, again noted that the apex 34 is disposed in the horizontal and longitudinal alignment with the apex 34.

The breaking element 31 is fixed within the burster to maintain the above-noted relationship of portions thereof with respect to the traverse of the web of paper thereover.

Figure 4:
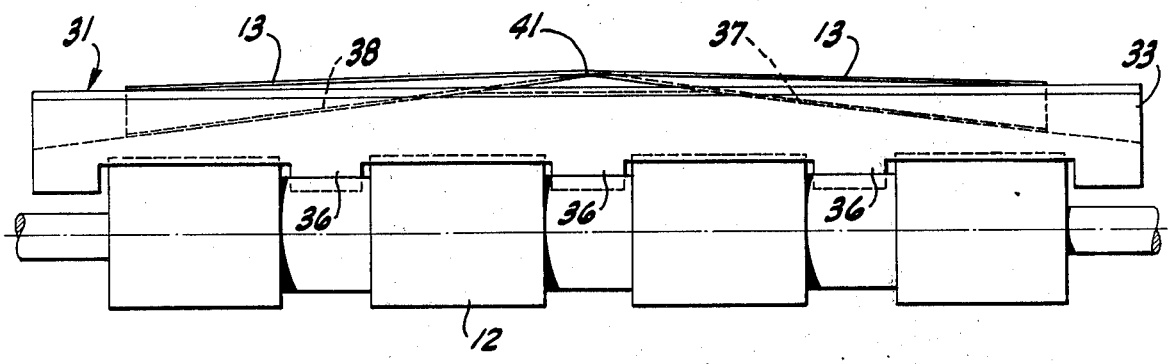
FIG. 4 is a front elevational view of the breaking element of the present invention, and illustrating a web of paper folded thereover during operation of the device.
Figure 5:
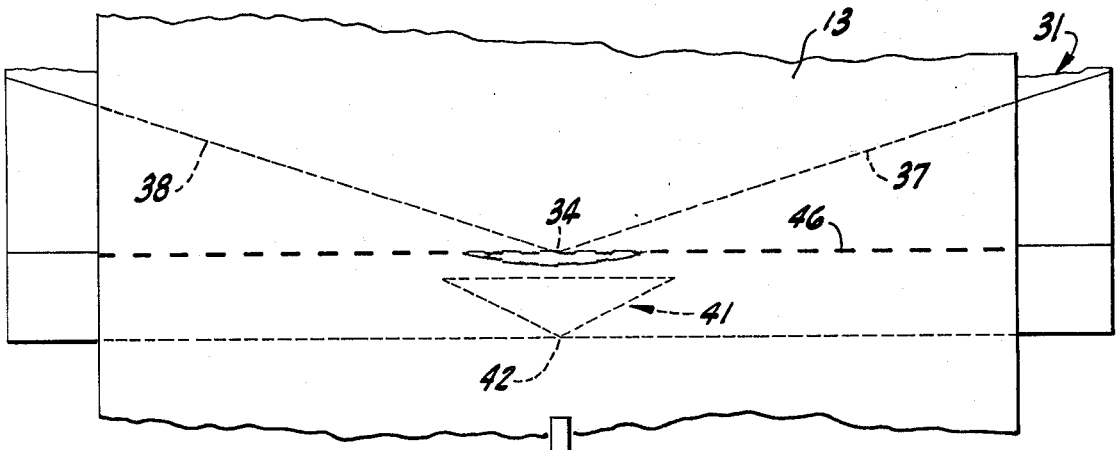
FIG. 5 is a partial plan view of a web of paper at the time of separation of a portion of a web of paper along a perforation line initiated by a burster in accordance with the present invention.

Considering now the operation of the present invention and referring particularly to FIGS. 4 and 5, will be seen that the leading edge of a web 13 which is fed to the left in FIG. 1 by a passage between the feed rollers 11 and 12 will move over the breaking element 31 by passing over the breaking surface 32. The web will thus be raised in the center thereof as it moves over the leading edges 37 and 38 of the breaking surface 32 with the high point of the web passing over the apex 34 of the surface 32. The leading edge of the web may take any of a number of different paths between the tapes 22 and 26 until it reaches the snap rollers 16 and 17, whereat this leading edge will be abruptly gripped and forcibly moved to the left in FIG. 1.

As the leading edge of the web 13 passes over the breaking element 31, it will be urged toward the draw or snap rollers 16 and 17 by the feed rollers 11 and 12 pushing the web forwardly. In general, the leading edge of the web will move along the lower tapes 22 until it reaches the roller 16 and 17 and, immediately upon entering the intersection of these rollers, it will be firmly gripped and rapidly drawn to the left in FIG. 1 inasmuch as the rollers 16 and 17 are rotated at a greater rate than the feed rollers. This will cause the web of paper to be "yanked" to the left in FIG. 1. The axes of the rollers 16 and 17 are horizontally displayed from the apex 34 of the breaking surface 32 by distance equal to the separation of the perforation lines along the web 13. Thus, as the draw rollers grip and rapidly move the web to the left, the paper will be forced onto the point 34 at the perforations so as to break the connecting bits of paper between the perforations, as indicated in FIG. 5. The paper will then be ripped laterally outward along the perforations from this center break, so as to tear across the perforations as the draw or snap rollers continue to move the leading portions of the web to the left. This then causes a complete separation of the first form or the like of the web from the remainder of the web. It is important to note that the burster does not operate as a continuous web device although a continuous web is fed therein inasmuch as separate sheets of paper are fed therefrom. The primary breaking surface 32 causes the paper to be lifted in the center thereof and to commence tearing along the perforations laterally outward from the center. This has been found to materially reduce the noise generated by the separation of each form from the following web. A ripping or tearing action is accomplished rather than a true bursting operation wherein all of the necks of paper between the perforations are simultaneously separated as in the prior art.

Figure 6:
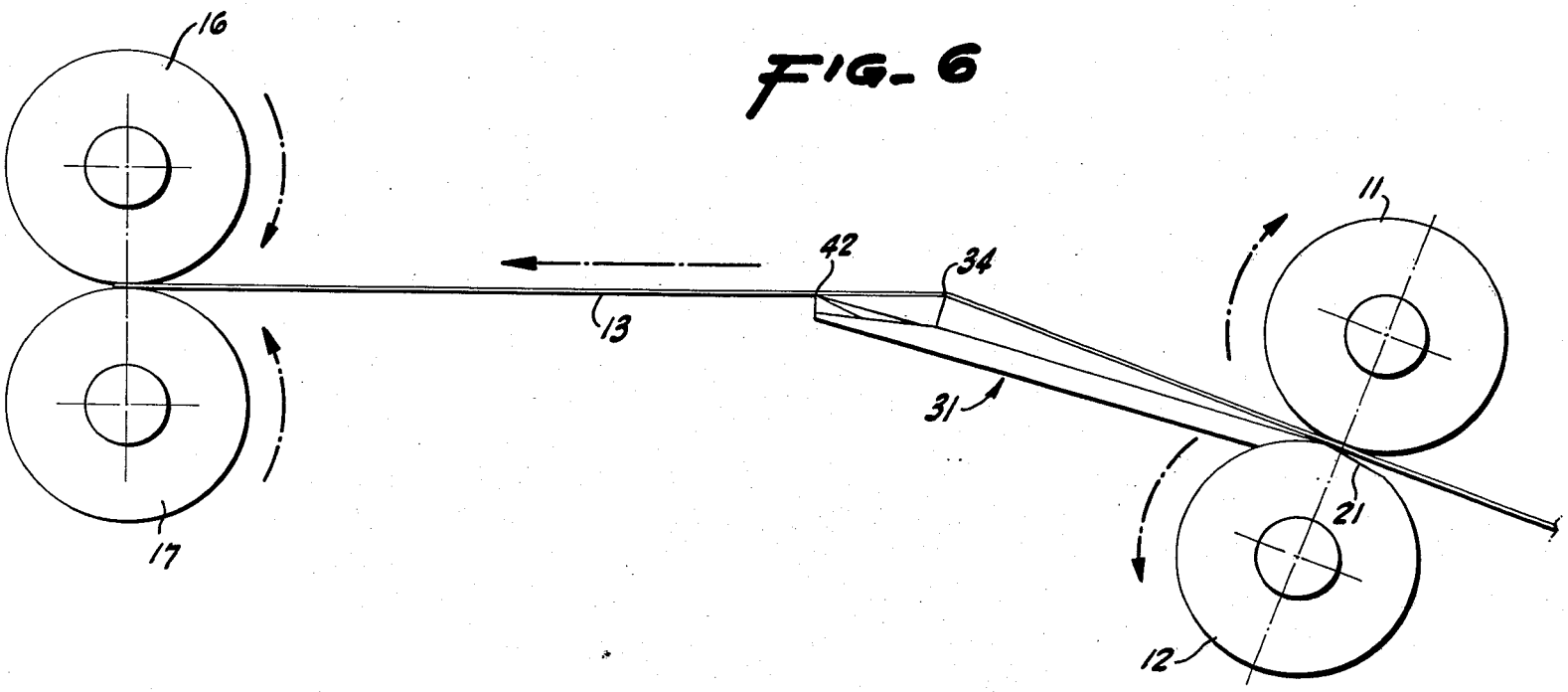
FIG. 6 is a diagramatic representation of burster operation showing the cause of intermittent misalignment of the perforation line with a predetermined breaking line.

The snap rollers are spaced from the primary breaking element a distance equal to the separation between lateral perforations of the web of paper and thus normally a perforation line is disposed immediately above the apex 34 of the triangular surface 32 at each time the draw rollers grip and rapidly urge the leading edge of the web forward. There is, however, a condition which occurs in the operation of bursters because of the necessity of providing a small flat surface 21 on at least one of the feed rollers. Bursters are designed to handle the separation of bursting of forms of different lengths. Thus, under these circumstances, it is not possible to provide a predetermined relationship between the circumference of the feed rollers and the length of the forms. Under the normal circumstances where the length of a form is not equal to the circumference of the feed rollers, it will be seen that a different point on the circumference of feed rollers engage the web each time that the draw rollers engaged the web to rip a perforation. With this situation existing, it will be seen that, eventually at least, the draw or snap rollers will initially engage the leading edge of the web 13 when the flat 21 of roller 12 is opposite the roller 11, so that the web is not firmly gripped by the feed rollers. Under this condition, the web will be readily moved to the left in FIG. 6 over the breaking surface without the breaking surface applying a force to the web. Only when the feed rollers have rotated slightly further from the situation in FIG. 6, will the web be forced upon the breaking surface and by this time, the perforation line 46 will have moved slightly to the left from the apex 34 of the breaking surface. Under these circumstances, conventional bursters apply the breaking or bursting in force behind the perforation line and often cause tearing of the web in scallops behind the perforation line. The present invention however, provides a secondary breaking unit 41 having an apex 42 aligned with the apex 34 of the primary breaking surface and spaced sufficiently therefrom that the perforation line will lie between the apex 34 and apex 42, or at most, immediately above the apex 42 when the feed rollers again grip the web. This configuration of the present invention then likewise causes the web to commence tearing at the center of the perforation line and because of the application of maximum force on both sides of the perforation line, the present invention precludes tearing of the paper itself upon either side of the perforation line. Thus, one of the problems existing in the prior art is entirely overcome by the present invention. The separation of the apex 34 from the apex 42 is made equal to the maximum distance that the web may be intermittently moved forwardly during location of the flat 21 of feed roller 12 opposite the feed roller 11, when the draw rollers have engaged the leading edge of the web. This distance will be seen to be determined by the relative rates of rotation of the pairs of rollers and the extent of the flat 21 on the roller 12. Conventional bursters normally require the draw or snap rollers to be rotated at about twice the speed of the feed rollers, however, the present invention requires less force to separate the web along a perforation line, so that it is possible to drive the draw rollers at a speed of only about one and one-half times that of the feed rollers. This then minimizes the possible distance that the perforation line may be displaced from the intended break line. As noted above, a conventional desk top burster employing the breaking element of the present invention requires a separation of the apexes by a distance of about three-quarters of an inch. It is noted that this problem has been treated in the art by providing flats in both pairs of rollers and the inclusion of complicated mechanical motions to maintain a fixed relationship therebetween, however, this is too expensive for many types of bursters.

The present invention is useful in both full-sized and table top bursters. It is also noted that the present invention is adapted to separate portions of single layer webs of paper or multiple layer webs which may include carbon paper between the layers. Although the present invention is by no means limited to any particular dimensions, it is noted, as a matter of interest, that one breaker element formed in accordance with the present invention has a plate width of 16" with the apex 34 of the primary breaking surface spaced from the trailing edge of the plate by 1" and the outer ends of the surfaces 37 and 38 spaced from this edge of the plate by 2". The plate itself may be inclined with respect to horizontal so that with the apex 34 extending a quarter of an inch above the top of the plate, the apex 42 may extend a quarter of an inch above the front edge of the plate, and the points of these apexes yet lie in the same horizontal plane. Although the exact configuration and dimensions of the secondary breaking unit 41 may be varied, it is noted that in the foregoing example, the total length thereof laterally of the plate is 2" and the width thereof longitudinally of the plate is three-quarters of an inch.

In the foregoing description of the present invention, no attempt has been made to show all details of a burster inasmuch as relatively conventional mounting, drive and adjusting means may be employed. The present invention is primarily directed to the breaking surface or surfaces of a burster and thus the present description is generally referenced thereto. The present invention provides a substantial advancement in the art by overcoming various problems thereof. In particular, the present invention materially reduces the noise level associated with rapid separation of successive forms from a continuous web of stationery. In addition, the present invention provides for separation of these forms only along perforation lines laterally of the web, even though the web may, in fact, slip intermittently during passage through the burster. The device of the present invention is herein termed a burster in conformity with the prior art terminology for machines which separate successive forms from a continuous web even though the physical separation of successive forms does not, in fact, burst successive forms from the web. Quite to the contrary, the present invention provides for tearing along a perforation line as fully described above.

Although the present invention has been described with respect to a single preferred embodiment thereof, it will be appreciated that numerous modifications and variations may be made within the scope of the present invention, and consequently, it is not intended to limit this invention to the precise terms of description or details of illustration.

What is claimed is:

1. In a burster for separating successive sheets of paper from a continuous web along lateral perforation lines and having a pair of driven feed rollers spaced from a pair of snap rollers driven at a greater speed than said feed rollers, the improvement comprising a breaking element disposed between said pairs of rollers and having a triangular upper surface with the apex thereof horizontally aligned with the contact of said snap rollers and said triangular upper surface being inclined downwardly from the apex to the base adjacent the contact of said feed rollers and a secondary breaking unit having sides slanted inwardly and upwardly to a forward apex displaced from the apex of said triangular upper surface toward said snap rollers with said apices being horizontally aligned and also aligned longitudinally of the traverse of paper through the burster whereby paper moved by said feed rollers over said breaking element folds thereover for tearing the paper along a perforation line each time the snap rollers grip and pull the paper.

2. The improvement of claim 1 further defined by a plate from which said triangular upper surface and said secondary breaking unit extend and said plate being mounted in fixed position in said burster between said pairs of rollers.

3. The improvement of claim 1 further defined by said triangular upper surface extending laterally at the base thereof substantially entirely across the length of said feed rollers.

4. The improvement of claim 1 further defined by the contact of said feed rollers being disposed below a horizontal plane through the contact of said snap rollers and the apex of said triangular surface whereby paper is fed along the upward incline of said triangular surface by said feed rollers to fold over the apex of said triangular surface so that gripping of the paper by the snap rollers rotating at a greater rate than the feed rollers cause the paper to be torn by said apex at the center of a perforation line across the paper and progressively torn outward along the perforation line to minimize noise generation during paper separation.

5. The improvement of claim 1 further defined by said triangular upper surface having a centrally located apex directed toward said snap rollers and said surface being inclined downwardly from the apex toward said feed rollers to dispose the sides of the triangular surface which form edges of the surface extending across the path of paper between the pairs of rollers with said edges being inclined downwardly from the apex toward to the ends of the feed rollers so that paper rides on these edges in passage over the breaking element.

6. The burster of claim 1 in which the secondary breaking unit is inclined with respect to the horizontal at a greater degree than the sides of said triangular upper surface whereby paper passing over said breaking element engages the apex and sides of said triangular surface.

7. The burster of claim 6 wherein said secondary breaking unit is formed to that of a pyramid.

8. The burster of claim 6 wherein the apex of the triangular upper surface is centrally located to extend toward said snap rollers, and wherein the lateral extension of said triangular upper surface is substantially equal to the lateral extension of said feed rollers for support of the paper throughout its width dimension whereby paper moved by said feed rollers is supported in movement toward said breaking element to feed over said apex for tearing progressively the paper from a central location along a perforation line each time the snap rollers grip and pull the paper.

9. In a burster for separating successive sheets of paper from a continuous web along lateral perforation lines and having a pair of driven feed rollers spaced from a pair of snap rollers driven at a greater speed than said feed rollers, the improvement comprising a breaking element disposed between said pairs of rollers and having a triangular upper surface with the apex thereof horizontally aligned with the contact of said snap rollers and said triangular upper surface being inclined downwardly from the apex to the base adjacent the contact of said feed rollers and a secondary breaking unit in the form of a pyramid having the apex thereof horizontally aligned with the apex of said triangular surface on the side of said snap rollers therefrom and said apices being aligned with the mid-points of said rollers and separated a short distance from each other whereby paper moved by said feed rollers over said breaker element folds thereover for tearing the paper along a perforation line each time the snap rollers grip and pull the paper.

10. The improvement of claim 9 further defined by the sides of said secondary breaking unit being inclined with respect to horizontal at a greater degree than the sides of said triangular surface whereby paper passing over said breaking element engages the apex and sides of said triangular surface.

* * * * *